US005738170A

United States Patent [19]

Lavernhe

[11] Patent Number: 5,738,170

[45] Date of Patent: Apr. 14, 1998

[54] COMPACT DOUBLE SCREEN ASSEMBLY

[75] Inventor: Philippe O. Lavernhe, Poitiers, France

[73] Assignee: United States Filter Corporation, Palm Desert, Calif.

[21] Appl. No.: 707,300

[22] Filed: Sep. 3, 1996

[51] Int. Cl.[6] ..... E21B 43/08

[52] U.S. Cl. ..... 166/228; 166/231; 166/233; 210/497.1

[58] Field of Search ..... 166/228, 231, 166/232, 233, 234; 210/497.1

[56] References Cited

U.S. PATENT DOCUMENTS

| | | | |
|---|---|---|---|
| 726,418 | 4/1903 | Fox | 166/231 X |
| 2,081,190 | 5/1937 | Wilson | 210/497.1 |
| 4,487,259 | 12/1984 | McMichael | 166/228 |
| 4,657,079 | 4/1987 | Nagaoka | 166/231 |
| 4,821,800 | 4/1989 | Scott et al. | 166/228 |
| 4,858,691 | 8/1989 | Ilfrey et al. | 166/278 |
| 5,004,049 | 4/1991 | Arterbury | 166/228 |
| 5,293,935 | 3/1994 | Arterbury et al. | 166/231 X |
| 5,642,781 | 7/1997 | Richard | 166/231 |

OTHER PUBLICATIONS

Johnson Thin–Pack Screens (3 page brochure published earlier than 1993).

*Primary Examiner*—Hoang C. Dang
*Attorney, Agent, or Firm*—Barry L. Clark

[57] ABSTRACT

A compact double screen assembly (20), which can be used alone or mounted on a perforated pipe base (22), has a plurality of rods (30) arranged in cylindrical fashion around an axis (23). A wire (34) is helically wound about the rods (30) and welded thereto at every intersection. Adjacent rods (30) are separated by an inter-rod gap having a slot distance X while adjacent turns of the wire have an inter-turn slot distance Y therebetween. The rods (30) are closely spaced together such that the inter-rod slot distance X is on the order of 80–120% of the inter-turn slot distance Y, and preferably equal to it. A packing cavity (42) is provided between the rods (30) and the wire (34) for accommodating a porous media or packing material (40). Specially tapered or concave sidewall surfaces on the rods (30) according to the present invention enhance the size of the packing cavity (42) and, when the assembly is mounted on a perforated pipe base 22, permit flow to take place beneath the rods through perforations (24) in the pipe base (22). Rods (30', 30", 30'", 30"") according to the present invention have a center of mass which is closer to a pipe base-contacting end (52) of the rod than to a wire-contacting apex (52) of the rod.

15 Claims, 1 Drawing Sheet

FIG. 1
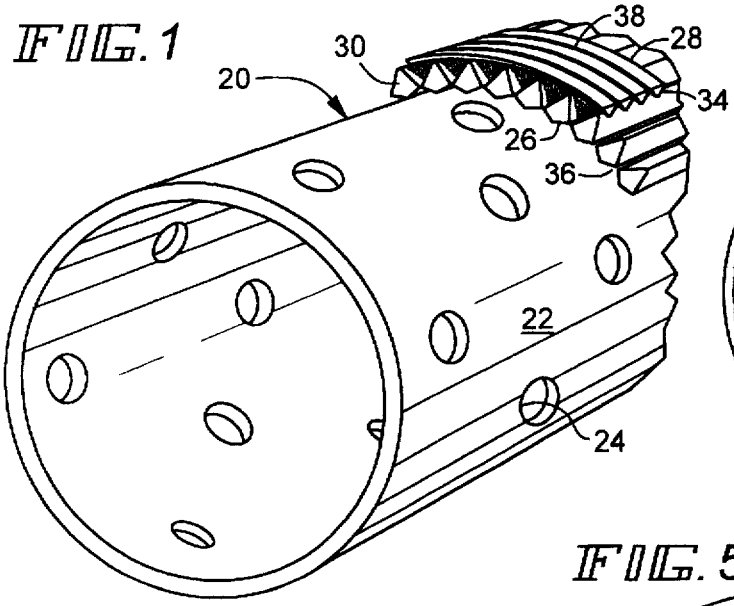
FIG. 3
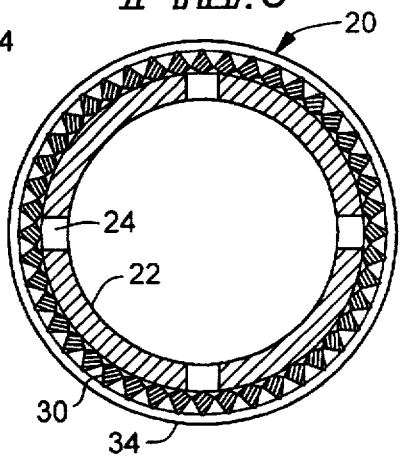
FIG. 5
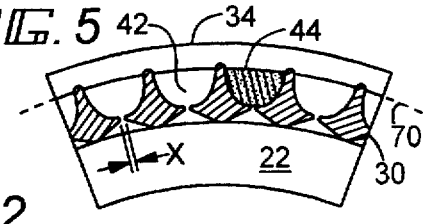
FIG. 2
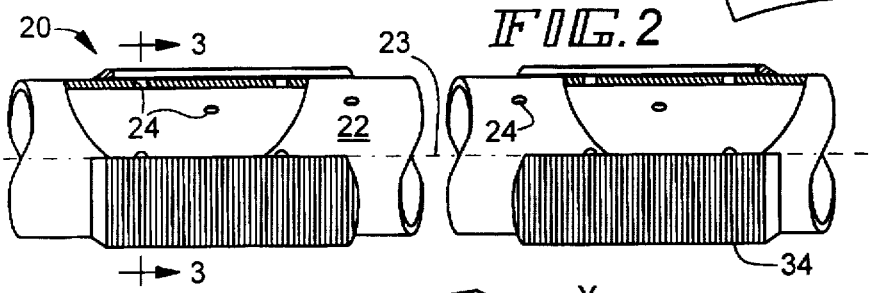
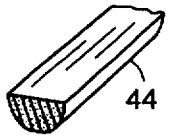
FIG. 5A
FIG. 10
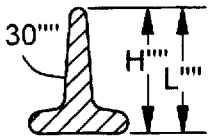
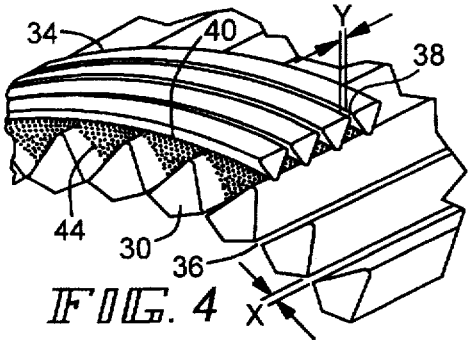
FIG. 4
FIG. 6
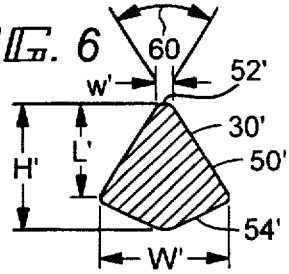
FIG. 7
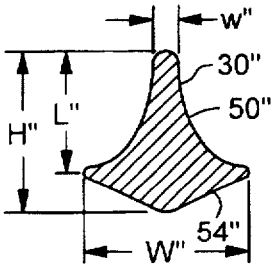
FIG. 8
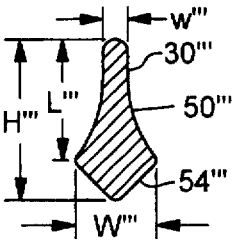
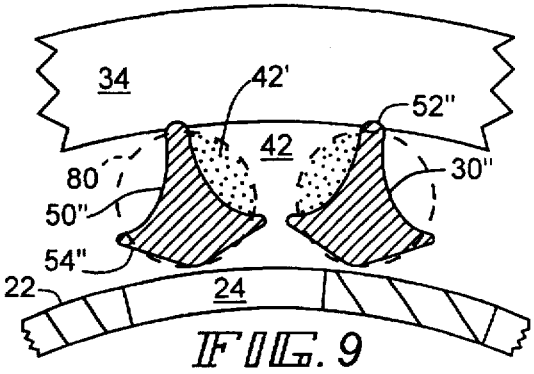
FIG. 9

COMPACT DOUBLE SCREEN ASSEMBLY

BACKGROUND

This invention pertains to apparatus useful for filtering particulate matter from a fluid, and particularly to screens used in the completion of oil wells. Such wells often extend to depths of several thousand feet and, in the case of deviated wells, have portions along their length which are drilled at a substantial angle to the vertical, including horizontal. As the well is drilled and casing inserted in the hole, information is obtained as to the various depths at which the formation can be expected to yield significant quantities of oil. After the well is drilled, one or more sections of screens and many sections of casing or pipe string portions are attached to each other and are lowered into the hole so that the screen sections are positioned opposite the locations where oil is to be collected. The outer casing can be left in place and can either be pre-perforated or perforated downhole at the locations where oil from the formation is to be filtered and collected by the screens. Alternatively, the outer casing can be withdrawn as a gravel packing is placed around the inner pipe string and screen segments since the gravel packing can retain the formation. Sealing packers placed at each end of the screen sections ensure that fluid will only be pumped from the desired region of the formation. It is usually desirable to have a gravel pack around the screen section, whether or not there is an outer casing. The gravel pack and sealing packers cooperate with each other to retain fine particles of sand in the formation. The gravel pack would also apply some pressure drop to the fluid being pumped from the formation and thereby cause it to enter the screen section relatively uniformly around its circumference and along its length. The uniform flow into the screen helps prevent uneven wear of the screen slots from the abrasion caused by a high velocity flow of particulate containing liquid against a portion of the screen that might include a slot having a width slightly greater than the slot width in other regions of the screen. Obviously, the additional abrasion resulting from having a much greater volume of flow through one area would increase the slot width even more and a situation could be reached where the slots might be no longer able to filter out the sand or other particulate material, the presence of which would be intolerable.

Since the cost of drilling large diameter well holes is much greater than the cost of drilling small diameter holes and since the cost of large diameter casing is much greater than the cost of small diameter casing, it would seem to be desirable to drill well holes with as small a diameter as possible. However, since it also desirable to get a substantial volume of oil out of the ground as rapidly as possible, the internal diameter of the pipe base member upon which the screen is usually mounted should also be quite substantial. Furthermore, for ease of lowering a section of screen into a well, and especially where the well is deviated and has slightly curved sections of casing, a radial clearance must be provided between the screen and casing. Typically, screen segments used in wells of the type described comprise an assembly consisting of two separate, spaced apart concentric screens having a radially extending annulus region located therebetween which is filled with a particulate material such as sand or gravel having a particle size greater than the width of the flow openings in the screen. The particulate material is often bonded together with resin to form a solid porous mass. The use of a prepacked dual screen assembly is highly desirable when the well it is to be used in is horizontal. When a well is vertical, it is relatively easy to insert a gravel pack between the outside of the screen and the inside of the borehole but it would seem to be impossible to get an effective gravel pack installed in a horizontal well since the packing material could never be packed as tightly together in the region above the screen as in the region below the screen.

An example of a prepacked dual screen assembly is shown in Arterbury U.S. Pat. No. 5,004,049. Such screens are usually formed in the conventional manner of having a wire helically wrapped around a plurality of axially extending support rods. The wire in the outer screen portion of the assembly is welded to the rods at every intersection therewith and is wound at a pitch which will produce a plurality of narrow parallel slots of a uniform width. The wire in the inner screen portion is similarly welded to another set of rods at every intersection therewith and is also wound at a pitch which will produce a plurality of narrow parallel slots of uniform width. The aforementioned inner and outer screen segments are concentrically positioned and retained on a length of a perforated pipe base support member by means such as welded end rings, resulting in an assembly which provides great strength and rigidity. An alternative double screen arrangement is disclosed in FIGS. 9 and 10 of Ilfrey et al U.S. Pat. No. 4,858,691 wherein a woven mesh layer lies directly on the pipe base member. McMichael U.S. Pat. No. 4,487,259 and the aforementioned Arterbury U.S. Pat. No. 5,004,049 typify the prior art in showing that the open space or distance between adjacent rods is considerably greater than the width of the slot formed between adjacent rams of the helically wound wire. Accordingly, the width of the slot openings between the wires determines the maximum particle size that can pass through the screen. Both of the noted patents also depict the conventional practice of utilizing rods which have a circular cross section and wires which have a "V-shaped" cross-section.

SUMMARY

A compact double screen assembly has an internal open area which can accommodate packing material while requiring only about the same amount of radial space as a conventional single screen assembly without packing material. Thus, the typical thickness of the packed screen assembly can be reduced and its OD decreased, as compared to screen assemblies previously used. The improved construction would produce lower friction forces during horizontal well completions and would also cost less than previously used screen assemblies. The double screen assembly includes a plurality of rods of non-circular cross-section and a wire which is helically wound about the rods and attached thereto by welding at each point of intersection. Adjacent rods are separated by an inter-rod gap or slot distance X; while adjacent turns of the wire have an inter-ram slot distance Y therebetween. The rods are closely spaced together such that the inter-rod slot distance X is on the order of the inter-turn slot distance Y. A packing cavity is provided between the rods and the wire for accommodating a packing material. By using particular non-cylindrical cross-sectional shapes for the rods in accordance with several embodiments of the present invention so that the center of gravity (c/g) of the rods will be at a point spaced from their top which is at least 70% of their height, the size of the packing cavity can be maximized. Also, by providing a rather pointed end to the rods at their radially innermost portions, fluid flow can take place beneath the rods when the screen assembly is mounted on a perforated pipe base member in immediate contact with the perforations in the pipe base member. Both the wires and rods are sufficiently closely spaced so as to provide a screening or filtering action while, as noted supra, the rods have special cross-sectional shapes. The special cross-sectional shapes accommodate a substantial quantity of packing material in the internal open space between the side wall portions of the rods which are above the points thereof which define the rod slots and beneath the portions of the wires which define the wire slots. The close spacing of the rods means that many more rods are present than in the usual screen assembly. These extra rods strengthen the screen and increase its resistance to the tensile strain applied to it as it is dragged through a casing or open hole.

BRIEF DESCRIPTION OF THE DRAWINGS

The foregoing and other objects, features, and advantages of the invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

FIG. 1 is a perspective view, partially broken away, of a portion of a packed double screen assembly mounted on a pipe base support member according to one embodiment of the invention.

FIG. 2 is a partial side view, partially broken away, of a portion of the double screen assembly of FIG. 1.

FIG. 3 is an axial cross sectional view taken along line 3—3 of FIG. 2.

FIG. 4 is an enlarged perspective view of a portion of a double screen assembly similar to FIG. 1 but illustrating how the assembly can be utilized by itself without a pipe base support member.

FIG. 5 is a detailed axial cross sectional of a portion of a screen according to an embodiment of the invention with one porous insert member shown in installed position.

FIG. 5A is a perspective view showing packing material that has been preformed into an elongated insert member.

FIG. 6 is an enlarged axial cross-sectional view of a rod utilized in the double screen assembly of FIG. 1.

FIG. 7 is an axial cross-sectional view of another embodiment of a rod usable in the double screen assembly of FIG. 1.

FIG. 8 is an axial cross-sectional view of yet another embodiment of a rod usable in the double screen assembly of FIG. 1.

FIG. 9 is a schematic, partial axial cross-sectional view of a screen according to an embodiment of the invention for sake of illustrating advantages thereof.

FIG. 10 is an axial cross-sectional view of an embodiment of a rod usable in the pipeless double screen assembly of FIG. 4

DETAILED DESCRIPTION OF THE DRAWINGS

FIG. 1 is a broken-away depiction of a compact double screen assembly 20 according to an embodiment of the present invention. The double screen assembly 20 includes a perforated pipe base support member 22 having a central axis 23 (FIG. 2) and perforations 24; a first or interior screen portion 26 and a second or exterior screen portion 28. Although the details of the screen structure are better understood with reference to ensuing drawings, FIG. 1 also shows that interior screen portion 26 is integrally joined to exterior screen portion 28 and is comprised of a plurality of longitudinally extending (i.e., parallel to axis 23) rods 30. Exterior screen portion 28 is comprised of helically wound wire 34. The interior and exterior screen portions 26, 28 are welded to each other at every point of contact between the wires 28 and the rods 30. The wire 34 is helically wrapped over and welded to the rods 30 at a pitch so as to form outer screen slots or openings 38. The rods 30 are spaced at a pitch as to form inner screen slots or openings 36. As will be hereinafter described, the present invention features, among other things, a unique spacing and cross sectional shapes for the rods 30 which form the interior screen portion 26.

FIG. 2 shows a side view of double screen assembly 20 telescopically mounted on a perforated pipe base member 22, while FIG. 3 shows an axial view thereof. As shown in FIG. 3, as well as in perspective in FIG. 1, rods 30 are circularly arranged about the circumference of pipe base member 22. The rods 30 of the present invention have a slot opening 36 of a width X (FIG. 4) formed between adjacent rods which is on the order of the slot opening 38 of a width Y (FIG. 4) which is formed between adjacent rams of wire 34.

FIG. 4 is similar to FIG. 1 but omits the pipe base support member 22 which is not always required. For example, whereas the pipe base design shown in FIGS. 1–3 would be used in typical applications for new wells where several thousand feet may be run in the borehole, the pipeless design could be used in applications where relatively short lengths (less than 500') are required. Examples are liners for existing wells and in multi-lateral wells. The figure shows a packing material or porous media 40 inserted in a cavity 42 between rods 30 and wire 34. The porous media 40 can be sand, which is often bonded with resin to form a solid porous filter pack, or any other commonly employed packing material. The nature of the packing material 40 depends upon the particular screen and its application. The porous media 40 could even be in the shape of an elongated porous insert member 44, (FIG. 5A) such as one made of a sintered material. The sintered material could be metal, a high temperature plastic or a ceramic which could be preformed into a generally U-shaped configuration and then pressed into the packing cavity 42, as shown in FIG. 5. Although FIGS. 1 and 4 show rods 30 having a cross-sectional shape as in FIG. 6, it is preferred that a pipe base design such as shown in FIG. 1 have a rod shape more like those shown in FIGS. 6 or 7 while the pipeless construction of FIG. 4 would preferably have an inverted T-shape, as shown in FIG. 10.

FIG. 5 shows the relative spacing of rods 30 of the present invention relatively to one another, specifically illustrating rod 30" of FIG. 7. As shown in FIG. 5, rods 30 are concentrically arranged about pipe axis 23, so that rods 30 have their maximum width points lying in an imaginary cylindrical surface 70. An open slot 36 having an inter-rod spacing distance X separates adjacent rods 30 along surface 70 in a plane perpendicular to pipe axis 23. That is, distance X separates the maximum width portions of adjacent rods 30. Distance X is on the order of a distance Y, the width of the open slot 38 which separates adjacent segments (i.e., turns) of wire 34 (see FIG. 4). Depending upon the filtering action to be performed by the screen assembly, the distance X is between 120% and 80% of distance Y, and preferably, distance X is substantially equal to distance Y. For example, in the specific embodiments referenced in TABLE II, dimensions X and Y are each 0.012".

FIGS. 6–8 show cross sectional (axial) shapes of rods 30', 30", and 30''' according to respective exemplary embodiments of the present invention. Each rod 30', 30", and 30''' has a correspondingly superscripted height H, taken radially with respect to pipe axis 23, maximum width W, top width w, and a radial distance L. The distance L is the distance from the wire-contacting top portion of the rod 30 to the point along height H at which rod 30 has its maximum width W. In all embodiments of the present invention, L is preferably greater than 0.7 H.

Each rod 30 has two major sidewalls 50 which meet at rounded rod apex 52, as well as two minor sidewalls 54 which meet at an essentially pointed rod base 56. As shown in FIG. 6, rod 30' has essentially straight but inclined major sidewalls 50' which intersect at an angle 60, with angle 60 being On the order of about 60 degrees. Rod 30' thus has a substantially arrowhead shaped cross-section. Rod 30" of FIG. 7 and rod 30''' of FIG. 8, on the other hand, have concavely curving or tapered major sidewalls 50" and 50''', respectively, with sidewall 50" of rod 30" being curved to a greater extent and to a greater width that sidewall 50''' of rod 30'''. Rod 30" thus has concave opposing sidewall surfaces which give it a substantially anchor shaped cross-section while rod 30''' has a cross-sectional shape more like a bowling pin.

Examples of dimensional values for various parameters of the wire 34 and rod 30 are provided in Table 1.

TABLE 1

Wire/Rod Parameter Values

| | MINIMUM | TYPICAL MINIMUM | TYPICAL MAXIMUM | MAXIMUM |
|---|---|---|---|---|
| Wire Width | 0.030" | 0.047" | 0.100" | 0.118" |
| Wire Height | 0.050" | 0.088" | 0.160" | 0.182" |
| Rod Width w | 0.025" | 0.030" | 0.045" | 0.050" |
| Rod Width W | 0.090" | 0.137" | 0.197" | 0.236" |
| Rod Height H | 0.140" | 0.197" | 0.315" | 0.393" |
| Rod Dimension L | 0.112" | 0.158" | 0.252" | 0.314" |
| Wire Slot Width Y | 0.002" | 0.006" | 0.020" | 0.040" |
| Rod Slot Width X | 0.002" | 0.006" | 0.020" | 0.040" |
| Media Size | 40/100 | 40/60* | 12/20 | 6/10 |

*100% of particles will pass 40 mesh screen & 100% will be retained by 60 mesh screen. When a porous insert is used, one having a 200 micron pore size would be equivalent to a 40/60 sand media.

Some parameters for two different double wall screen assemblies made in accordance with the invention are indicated in TABLE II for both a pipe base design, as shown in FIGS. 1–3, and a pipeless design such as shown in FIG. 4.

TABLE II

| | PIPE BASE DESIGN (FIGS. 1–3) | PIPELESS DESIGN (FIG. 4) |
|---|---|---|
| Pipe Diameter | 5.5" | 3.5" |
| Screen Assembly ID | 5.6" | 3.0" |
| Screen Assembly OD | 6.30" | 3.80" |
| Wire Width | 0.100" | 0.150" |
| Wire Height | 0.150" | 0.200" |
| Rod Width w | 0.035" | 0.035" |
| Rod Width W | 0.150" | 0.150" |
| Rod Height H | 0.200" | 0.200" |
| Rod Dimension L | 0.160" | 0.200" |
| Wire Slot Width Y | 0.012" | 0.012" |
| Rod Slot Width X | 0.012" | 0.012" |
| Cross-Sectional Shape | Like FIG. 7 | Like FIG. 10 (Inverted T) |
| Media Size | 20/40 | 20/40 |

While several cross-sectional shapes of rods 30', 30", and 30''' have been specifically illustrated herein, it should be understood that other shapes are contemplated which will provide the maximum possible fill volume to the packing cavity 42. Specifically, other cross sectional shapes having, with respect to rod cross-section, a center of mass much closer to the radially innermost or pipe-contacting rod base end than to the wire-contacting rod apex end, are expressly envisioned within the scope of the present invention. More particularly, it is preferred that the center of gravity or center of mass of the rod be located at a point spaced away from the wire end of the rod by a distance which is at least 70% of the height H of the rod.

Prior art screens formed with cylindrically shaped (i.e., circular cross-section) rods have not had the rods positioned so closely together that the open space between adjacent rods is anywhere near being equal to the open slot space between adjacent wraps of the overlying helically wound wire to which the rods are welded. Furthermore, even if such cylindrically shaped rods were so positioned, the size of the cavity between adjacent rods and the wire would be very small. It is not believed that an attempt has ever been made to place a packing material in the open cavity volume under the wire of a screen and above those portions of adjacent rods where the rods are closest to each other. However, even if cylindrical rods were positioned so as to form open slots having the same width as the wire slots, there would be extremely little cavity volume available between them. One of the disadvantages, of course, of a smaller cavity volume would be the decrease in the amount of packing material 40 which could be accommodated in the cavity. In the present invention, a cavity 42 of considerable size is achieved despite the close proximity of rods 30 to each other. See, for example, FIG. 9, wherein rods 30" are illustrated in contrast to prior art (circular cross section) rods 80 (shown in broken lines). While prior art rods 80 were not arranged in such close proximity as shown in FIG. 9, FIG. 9 well illustrates the advantages of the cross-sectional shapes of rods 30 of the present invention. The dotted portion 42' of cavity 42 shows the increase in cavity size achieved with the rod shape shown vis-à-vis the cavity size achieved with circular cross sectional rods. The concave or tapered rod major sidewalls 50 of the present invention thus enhance the size of packing cavity 42 and facilitate loading while increasing the amount of packing material 40 which can be accommodated. Thus, filter performance is improved.

In addition to achieving, by the use of specially profiled major sidewalls 50, an enlarged cavity 42 suitable for receiving a substantial amount of packing material, the inclined contour or profile of rod minor sidewalls 54 also provides an added functional benefit. As shown in FIG. 9, the profile of rod minor sidewall 54 increases the probability of flow through pipe perforations which happen to be in proximity to a rod, such as perforation 24. Perforations 24 typically have a diameter of about 0.375–0.500". Another benefit is provided by the narrow apex ends 52 of rods 30 which provide smaller intersection points with wire 34, and thus facilitate a more consistent and controlled weld. The pipeless design shown in FIG. 4 preferably has rods 30'''' which have an inverted T-shaped cross-section. Since they do not overlie a pipe base member they do not have to be able to provide clearance for flow through the perforations in such a member. By having a flat bottom, the cavity space available for receiving packing material is maximized.

While the invention has been particularly shown and described with reference to the preferred embodiments thereof, it will be understood by those skilled in the art that various alterations in form and detail may be made therein without departing from the spirit and scope of the invention.

The embodiments of the invention in which an exclusive property or privilege is claimed are defined as follows:

1. A generally cylindrical double screen assembly comprising a plurality of parallel rods extending essentially parallel to and spaced from the central axis of the screen assembly, and adjacent ones of said parallel rods being separated by an inter-rod spacing distance or rod slot opening dimension X, the rods having a wire helically wound thereabout and welded thereto so that adjacent wire segments have an inter-wire segment or wire slot opening dimension Y, wherein the improvement comprises X being between 80–120% of Y and wherein a porous media is located in the internal cavity formed between the wire and the sidewall portions of the rods which are located above the point at which adjacent rods are closest to each other.

2. A double screen assembly in accordance with claim 1 wherein the assembly is telescopically mounted on a perforated pipe base member.

3. A double screen assembly in accordance with claim 1 wherein X is substantially equal to Y.

4. A double screen assembly in accordance with claim 2 wherein the rods, in cross sectional view, have a height H and a dimension L which is equal to at least 70% of H, the dimension L being measured in a direction parallel to a vertical center plane of the rod in which H is measured and from the point where the rod is welded to the wire to the point where the rod has its maximum width W and is closest to an adjoining rod from which it is spaced by a rod slot distance X.

5. A double screen assembly in accordance with claim 4 wherein the rods each have generally symmetrical opposed sidewall portions which include points wherein the rods have their maximum width, the center of mass of said rods being located at a point which is at least 70% of the height H away from the point at which the rods are welded to said wire.

6. A double screen assembly in accordance with claim 4 wherein the rods have major and minor sidewall portions which intersect at the points where the rods have their maximum width.

7. A double screen assembly in accordance with claim 6 wherein the minor sidewall portions converge at an angle from the points where the rods have their maximum width to a lower tip portion wherein the rod is at its maximum height, thereby providing clearance so that fluid flow can take place through the perforations in said pipe base member at locations where the perforations underlie said rods.

8. A double screen assembly in accordance with claim 5 wherein the major sidewalls are concave.

9. A double screen assembly in accordance with claim 1 wherein the porous media is sand.

10. A double screen assembly in accordance with claim 9 wherein the sand is bonded with resin.

11. A double screen assembly in accordance with claim 1 wherein the porous media comprises a plurality of preformed members which are inserted in a direction parallel to the rods into the said internal cavities.

12. A double screen assembly in accordance with claim 11 wherein said plurality of preformed members have a generally U-shaped cross-section.

13. A double screen assembly in accordance with claim 1 wherein the values of X and Y are no greater than 0.040".

14. A double screen assembly in accordance with claim 1 wherein the values of X and Y are no greater than 0.020".

15. A double screen assembly in accordance with claim 1 wherein the rod has a generally inverted T-shaped cross-section.

* * * * *